United States Patent [19]

Yagi et al.

[11] Patent Number: 4,895,533

[45] Date of Patent: Jan. 23, 1990

[54] WATERPROOF PLUG FOR A CONNECTOR

[75] Inventors: Sakai Yagi; Kazuto Ohtaka; Hisashi Tsukamoto, all of Shizuoka, Japan

[73] Assignee: Yazaki Corporation, Tokyo, Japan

[21] Appl. No.: 310,169

[22] Filed: Feb. 13, 1989

[30] Foreign Application Priority Data

Feb. 12, 1988 [JP] Japan ..... 63-16348[U]
Feb. 12, 1988 [JP] Japan ..... 63-16349[U]

[51] Int. Cl.[4] ..... H01R 13/52
[52] U.S. Cl. ..... 439/587; 439/278
[58] Field of Search ..... 439/587–589, 439/278, 279

[56] References Cited

U.S. PATENT DOCUMENTS 4,735,581 4/1988 Endo et al. ..... 439/278
4,802,867 2/1989 Palmer ..... 439/587

*Primary Examiner*—P. Austin Bradley
*Attorney, Agent, or Firm*—Armstrong, Nikaido, Marmelstein, Kubovcik, Murray

[57] ABSTRACT

A waterproof plug for a connector comprising a rubber plug having an outer tube portion capable of fitting to the inner wall of a connector housing formed in the outer periphery of one side of a tubular portion which provides an electric wire inserting hole, and either a stabilizing tube having rigidity mounted between the tubular portion and the outer tube portion of said rubber plug or a stabilizing member having ridigity with supporting columns projected on the opposite sides of an elliptical base plate portion which is provided with an electric wire inserting hole in the central portion thereof.

4 Claims, 6 Drawing Sheets

(a)

(b)

WATERPROOF PLUG FOR A CONNECTOR

BACKGROUND OF THE INVENTION

1. Field of the Invention

The present invention relates to an improvement in a waterproof plug in a connector used to connect electric wires together.

2. Description of the Prior Art

The Applicant has previously proposed a waterproof plug as shown in FIGS. 4 to 6 and 13A, 13B and 13C (Japanese Utility Model Application Laid-open No. 147277/1987).

According to the aforesaid application, a waterproof plug 5 is designed in such a manner that a tubular portion *7a* whose inner portion is formed as an electric wire inserting hole *7b* is provided at one side thereof with a caulking portion *7c* for suppressingly fixing the electric wire together with a caulking member *2a* of a connecting terminal 2 and provided at the outer periphery of the other side with a rubber plug 7 formed with an outer tube portion *7d* which is capable of fitting to the inner wall of a connector housing 1, and a stabilizing tube 8 formed of a hard rigid resin insulator is provided between the tubular portion *7a* and the outer tube portion *7d*. An electric wire 3 inserted into the tubular portion *7a* is suppressingly fixed by means of the caulking portion *7c* of the rubber plug 7 and a caulking element *2a* of the connecting terminal 2. The connecting terminal 2 is doubly prevented from disengagement by a flexible stopping arm 4 and a rear holder 6 fitted facing to a flange portion *8a* of the stabilizing tube 8.

Recently, with an increase of electric appliances loaded on a vehicle, smaller size of connectors and connecting terminals have been earnestly demanded. If a connector is minimized to meet such demand as described, the rubber plug 7 is also minimized. As shown in FIGS. 5 and 7A, the inner diameter R of the stabilizing tube 8 is slightly larger than the external diameter D of the electric wire 3, and a tubular portion *7a'* of the rubber plug 7 becomes extremely thin. The tubular portion *7a'* comes into contact with the surface of the electric wire 3 when the latter is inserted, and therefore, the tubular portion *7a'* is pulled and tends to be torn inwardly as shown in FIG. 7B. Therefore, there gives rise to a drawback in that the tubular portion *7a'* is to generate a difference in level between the tubular portion *7a'* and the pleat *7e* within the electric wire inserting hole *7b* so that a waterproof sealing property is lowered and the insertion of the electric wire is made difficult.

Furthermore, with a recent increase of electric appliances loaded on the vehicle, a number of electric wires are wired within a limited space and therefore, smaller size of connectors and connecting terminals have been earnestly demanded.

In view of the above, as a means to make a waterproof connector smaller, the external diameter of the rubber plug 7 (or a waterproof plug 5) can be made small in order to reduce a lateral pitch. However, a sealing portion (a tubular portion *7a*) between the electric wire 3 and the rubber plug 7 and that an outer tube portion *7d* between the plug 7 and a housing 1 are in a concentric circular relation, and the rubber plug 7 including the stabilizing tube 8 needs to have a specified thickness in order to maintain the sealing property and the strength. It is noted that even if the stabilizing tube 8 is omitted, the waterproof plug will still function only with the tubular portion *7a* of the rubber plug but it is not possible to provide a double engagement of the connecting terminal. Accordingly, it is difficult to minimize the connector having a waterproof plug of the conventional construction.

SUMMARY OF THE INVENTION

It is therefore an object of the present invention to provide a waterproof plug having no drawback as noted above and adapted for formation of a connector into a small size.

It is a further object of the present invention to provide a waterproof plug for a connector suitable for minimization of a connector without impairing the sealing property of the connector and the double engaging function of a connecting terminal.

According to the first aspect of the present invention, there is provided a waterproof plug for a connector comprising a rubber plug wherein an outer tube portion capable of fitting to the inner wall of a connector housing is formed in the outer periphery of one side of a tubular portion whose inner portion is formed as an electric wire inserting hole, and a stabilizing tube having a rigidity mounted between the tubular portion and the outer tube portion of the rubber plug, characterized in that the rubber plug is integrally molded with the stabilizing tube and at least the end surface of an electric wire pulling side of the stabilizing tube is covered with a collar portion formed in continuation to the tubular portion.

According to the further aspect of the present invention, there is provided a waterproof plug for a connector comprising a rubber plug wherein an elliptical sealing portion capable of fitting to an inner wall of a connector housing is formed in the outer periphery of one side of a tubular portion whose inner portion is formed as an electric wire inserting portion and a stabilizing member having a rigidity with supporting columns projected on opposite sides of an elliptical base plate portion which is provided with an electric wire inserting hole in the central portion thereof, characterized in that the rubber plug is integrally molded with the stabilizing member, and the support columns are encased in the elliptical seal portion.

DETAILED DESCRIPTION OF THE PREFERRED EMBODIMENTS

Figure 1:
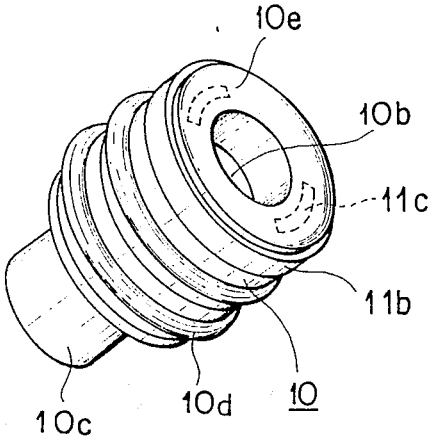
FIG. 1 is a perspective view showing a first embodiment of a waterproof plug according to the present invention.
Figure 2:
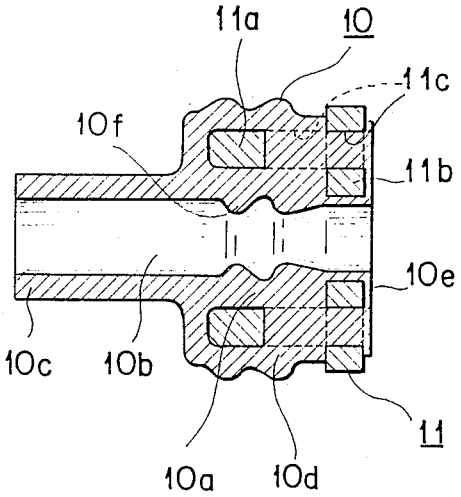
FIG. 2 is a longitudinal sectional view of the same.

Referring now to FIGS. 1 and 2, reference numeral 10 designates a rubber plug and 11 denotes a stabilizing tube. The rubber plug 10 has a tubular portion 10*a* whose inner portion is formed as an electric wire inserting hole 10*b*, a caulking portion 10*c* to suppressingly fix the electric wire together with a caulking member of a connecting terminal extended from one side thereof and an outer tube portion 10*d* formed in the outer periphery of the other side. The stabilizing tube 11 comprises a tube main body 11*a* mounted between the tubular portion 10*a* of the rubber plug and the outer tube portion 10*d* and a flange portion 11*b* at the rear end thereof, the stabilizing tube 11 being formed as a rigid body from a hard rigid resin insulator or the like.

The above-described structure is similar to that of the conventional product, but in the present invention, the rubber plug 10 is formed by double molding so as to embrace the premolded stabilizing tube 11, and the flange portion 11*b* is covered with a collar portion 10 formed as a continuation of the tubular portion 10*a*. Preferably, a plurality of holes 11*c* through which rubber flows in are provided in the tube main body 11*a* of the stabilizing tube 11 and the flange portion 11*b* to form a bridge in order to prevent disengagement of the rubber plug 10 and the stabilizing tube 11 after being molded.

Figure 3:
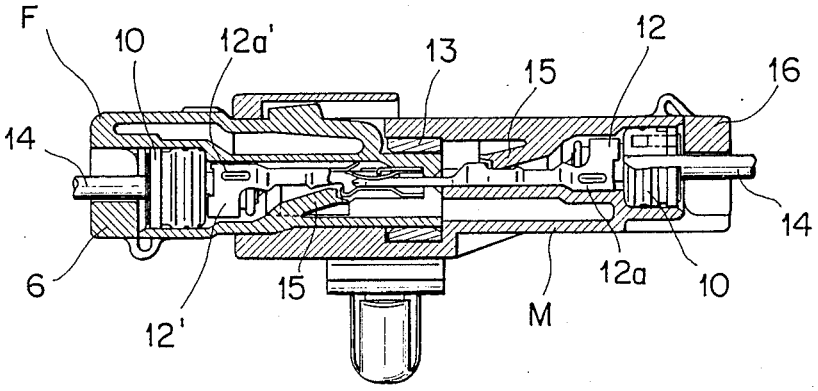
FIG. 3 is a sectional view showing a construction of a waterproof connector in use of the aforesaid waterproof plug.
Figure 4:
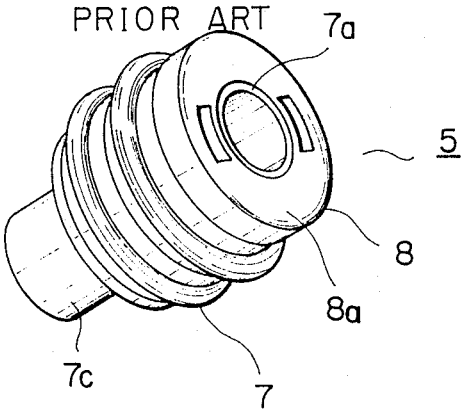
FIG. 4 PRIOR ART
FIG. 4 is a perspective view showing a conventional waterproof plug.
Figure 5:
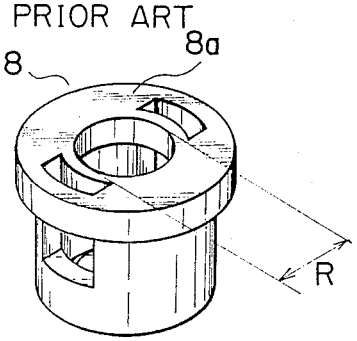
FIG. 5 PRIOR ART
FIG. 5 is a perspective view of a stabilizing tube of the conventional waterproof plug.
Figure 6:
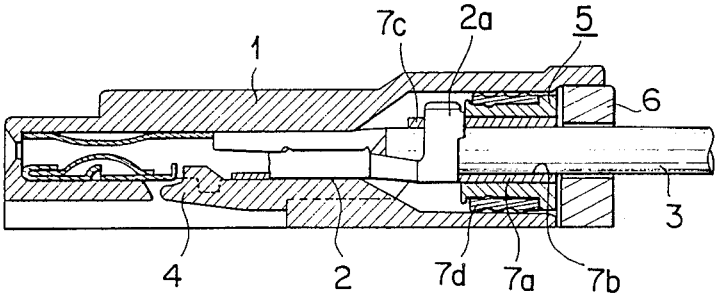
FIG. 6 PRIOR ART
FIG. 6 is a sectional view showing a construction of a waterproof connector in use of a conventional waterproof plug.
Figure 7A:
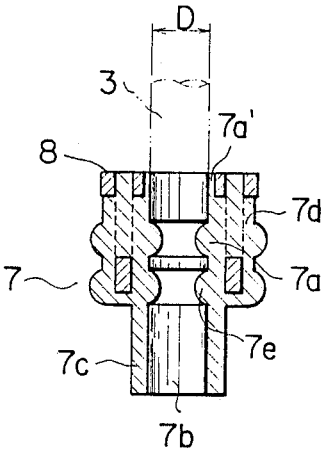
FIG. 7A PRIOR ART
FIGS. 7A and 7B are sectional views respectively showing the function of the conventional waterproof plug.
Figure 7B:
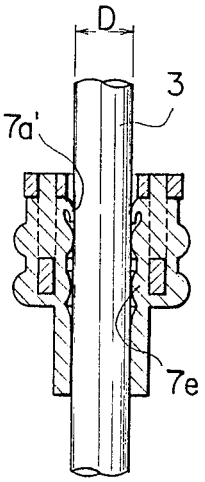
FIG. 7B PRIOR ART

In FIG. 3, reference character M designates a male housing encasing therein a male connecting terminal 12, and F denotes a female housing encasing therein a female connecting terminal 12'. A lip packing 13 is mounted in a fitted portion between both the housings to provide a waterproof sealing therebetween. An electric wire 14 is suppressingly fixed by means of the caulking portion 10*c* of the rubber plug 10 and a caulking element 12*a* (12*a'*) of the connecting terminal 12 (12'), and the waterproof sealing between the connecting terminal and the housing is effected by the outer tube portion 10*d* closely fitted to the inner wall of the housing. Reference numeral 15 designates a flexible stopping arm, and 16 is a rear holder.

In the waterproof plug according to the first embodiment as described above, the tubular portion 10*a* of the rubber plug 10 has its electric wire pulling side associated with the collar portion 10*e* covering the end surface (flange portion 11*b*) of the stabilizing tube 11.

Accordingly, there occurs no possible tearing of the tubular portion 10*a* when the electric wire 14 is inserted, and the wire inserting operation can be easily accomplished. In addition, even in the case where the pleat 10*f* is peripherally provided within the wire inserting hole 10*b*, no tearing of the tubular portion 10*a* occurs, and therefore, excellent sealing state between the electric wire 14 and the rubber plug 10 is obtained.

The second embodiment of the present invention will be described hereinafter.

Figure 8:
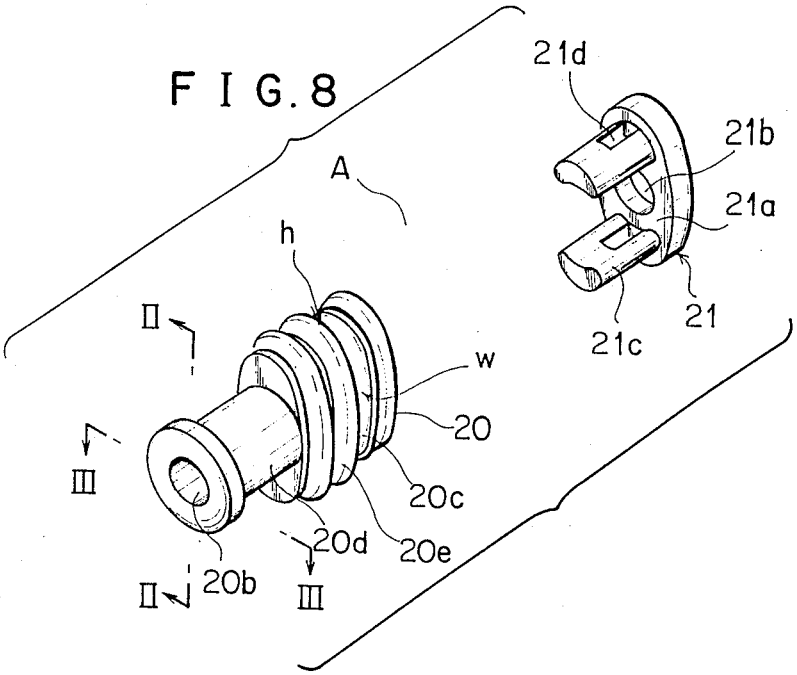
FIG. 8 is an exploded perspective view showing a second embodiment of a waterproof plug according to the present invention.
Figure 9:
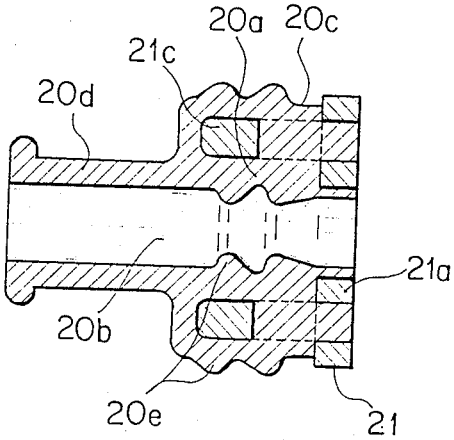
FIG. 9 is a sectional view of the assembly taken along line II—II of FIG. 8.
Figure 10:
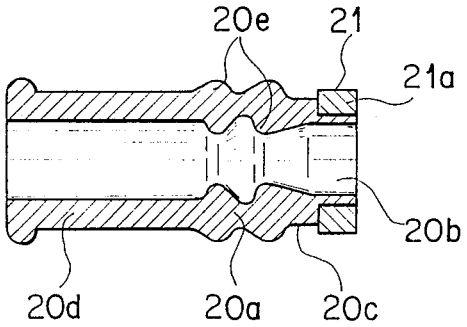
FIG. 10 is a sectional view taken along line III—III of FIG. 8.

A waterproof plug A for a connector according to the present invention comprises, as shown in FIGS. 8 to 10, a rubber plug 20 formed with an elliptical seal portion 20*c* capable of fitting to an inner wall of a connector housing 22 (see FIG. 11A and FIG. 12) formed in the outer periphery of one side of a tubular portion 20*a* whose inner portion is formed as an electric wire inserting hole 20*b*, and a stabilizing member 21 having a rigidity with supporting columns 21*c* projected on opposite sides of an elliptical base plate portion 21*a* which is provided with an electric wire inserting hole 21*b* in the central portion thereof, the rubber plug 20 being integrally formed with the stabilizing member 21, and the support columns 21*c* being encased in the elliptical seal portion 20*c*.

Since the inner wall of the connector housing 22 and the seal portion 20*c* of the rubber plug 20 are elliptical in shape, the shorter axis w thereof can be made substantially equal to the external diameter of the tubular portion 20*a* having a thickness required to seal an electric wire 25 (see FIG. 12), and the longer axis h thereof can be dimensioned to cover two supporting columns 21*c* of the stabilizing member 21 and provides a thickness to meet the required flexibility for sealing.

The stabilizing member 21 is pre-molded from a hard rigid resin insulator, and the rubber plug 20 is integrally formed with the molded member 21 by double molding. Preferably, a through-hole 21*d* for rubber during the molding operation is provided between the base plate portion 21*a* and each support column 21*c* so as to form a bridge for preventing a disengagement of the rubber plug 20 and the stabilizing member 21.

A caulking portion 20*d* provided for better wire connections together with a connecting terminal 23 (see FIG. 12) is extended in the tubular portion 20*a* of the rubber plug 20, and a plurality of pleats 20*e* are peripherally provided in the inner periphery of the tubular portion 20*a* and in the outer periphery of the sealing portion 20*c* to enhance the sealing property as previously mentioned.

Figure 11A:
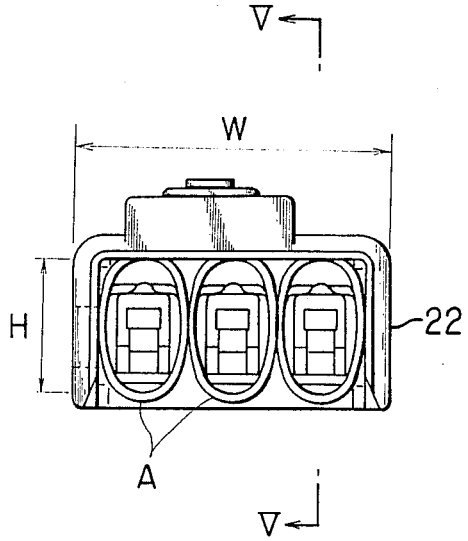
FIGS. 11A and 11B are respectively front views of a waterproof plug according to the present invention and a three-way waterproof connector in use of a conventional product.
Figure 11B:
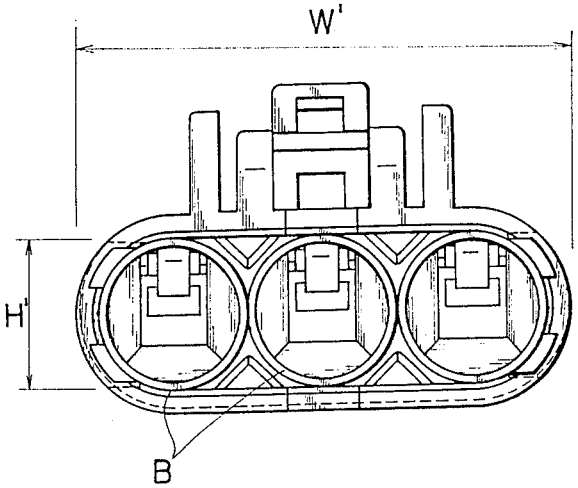
FIG. 11B PRIOR ART

FIGS. 11A and 11B show a three-way waterproof connector in use of the waterproof plug A according to the present invention and the conventional product B, respectively. As will be apparent from the drawings, since the waterproof plug A of the above embodiment is elliptical, heights H and H' of both connectors are substantially equal to each other but the widths W and W' is in the relation of $W < W'$, whereas the lateral width of the connector can be made small.

Figure 12:
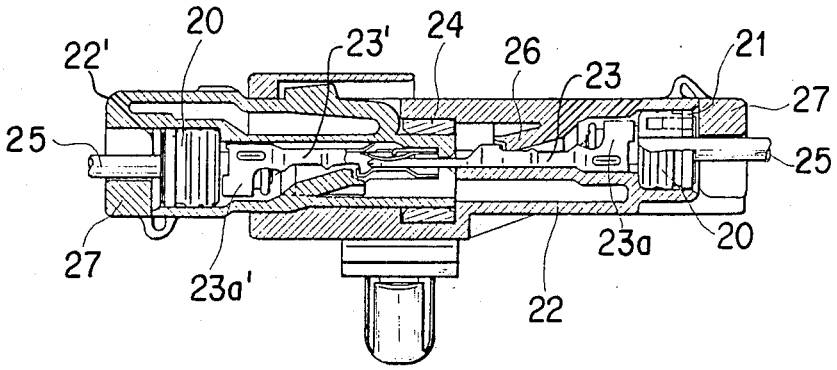
FIG. 12 is a sectional view taken along line V—V of FIG. 11A.
Figure 13A:
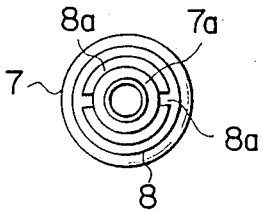
FIG. 13A PRIOR ART
FIGS. 13A to 13C are a front view, a side view and a sectional view, respectively, showing a waterproof plug of a conventional product.
Figure 13B:
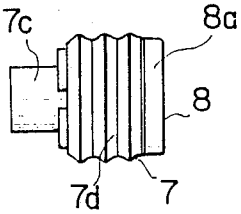
FIG. 13B PRIOR ART
Figure 13C:
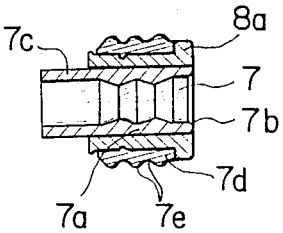
FIG. 13C PRIOR ART

FIG. 12 is a sectional view taken along line V—V of FIG. 11A, wherein reference numeral 22 designates a male connector housing encasing a male connecting terminal 23, and 22' a female connector housing encasing a female connecting terminal 23'. A lip packing 24 is mounted in a fitted portion between both housings to provide a waterproof sealing therebetween. An electric wire 25 is suppressingly fixed by means of the caulking portion 20*d* of a rubber plug 20 and a caulking element 23*a* (23*a'*) of the connecting terminals 23 (23'), and the waterproof sealing between each of the connecting terminal and the housing is effected by the elliptical seal portion 20*c* in close contact with the inner wall of the housing. Reference numeral 26 designates a flexible stopping arm and 27 denotes a rear holder.

As described above, in the waterproof plug for the connector according to the present invention, the tubular portion of the rubber plug is not possibly torn when the wire is mounted, and an excellent sealing state is obtained. The present plug has a construction well suited for formation of a connector into small size. Moreover, in the case that the sealing portion of the rubber plug with the connector housing is elliptical, the lateral width of the waterproof connector can be made small to provide formation thereof into a small size as a whole.

What is claimed is:

1. A waterproof plug for a connector comprising:

a rubber plug having an outer tube portion capable of fitting to an inner wall of a connector housing formed in the outer periphery of one side of a tubular portion which provides an electric wire inserting hole therein;

a stabilizing tube having rigidity mounted between said tubular portion and said outer tube portion of said rubber plug, characterized in that said rubber plug is integrally molded with said stabilizing tube and at least an end surface of an electric wire pulling side of said stabilizing tube is covered with a collar portion of said rubber plug formed as a continuation of said tubular portion.

2. A waterproof plug for a connector as claimed in claim 1, wherein said stabilizing tube comprises a tubular body and a flange portion at one end thereof, both being provided with a plurality of holes through which rubber flows in.

3. A waterproof plug for a connector comprising:

a rubber plug having an elliptical sealing portion capable of fitting to the inner wall of a connector housing formed in the outer periphery of one side of a tubular portion, the inner portion of said tubular portion being formed as an electric wire inserting hole; and, a stabilizing member having rigidity with supporting columns projected on the opposite sides of an elliptical base plate portion which is provided with an electric wire inserting hole in the central portion thereof, characterized in that said rubber plug is integrally molded with said stabilizing member and said supporting columns are encased in said elliptical sealing portion.

4. A waterproof plug for a connector as claimed in claim 3, wherein a through-hole is provided between said base plate portion and said supporting column.

* * * * *